US010309136B2

(12) United States Patent
Wang

(10) Patent No.: US 10,309,136 B2
(45) Date of Patent: Jun. 4, 2019

(54) LOCKING AND UNLOCKING MECHANISM FOR A DOOR LOCK

(71) Applicant: ILLINOIS TOOL WORKS INC., Glenview, IL (US)

(72) Inventor: Yang Wang, Dongguan (CN)

(73) Assignee: Illinois Tool Works Inc., Glenview, IL (US)

( * ) Notice: Subject to any disclaimer, the term of this patent is extended or adjusted under 35 U.S.C. 154(b) by 448 days.

(21) Appl. No.: 15/027,256

(22) PCT Filed: Aug. 12, 2014

(86) PCT No.: PCT/US2014/050788

§ 371 (c)(1),
(2) Date: Apr. 5, 2016

(87) PCT Pub. No.: WO2015/053855

PCT Pub. Date: Apr. 16, 2015

(65) Prior Publication Data

US 2016/0251883 A1 Sep. 1, 2016

(30) Foreign Application Priority Data

Oct. 11, 2013 (CN) ..... 2013 1 0473511
Apr. 29, 2014 (CN) ..... 2014 1 0178041

(51) Int. Cl.
*E05C 19/16* (2006.01)
*A47L 15/42* (2006.01)
(Continued)

(52) U.S. Cl.
CPC ..... *E05C 19/166* (2013.01); *A47L 15/4259* (2013.01); *D06F 37/42* (2013.01); *E05C 1/08* (2013.01); *E05C 19/063* (2013.01)

(58) Field of Classification Search
CPC ..... Y10S 292/69; Y10S 292/65; D06F 37/42; E05B 47/0009; E05B 79/20;
(Continued)

(56) References Cited

U.S. PATENT DOCUMENTS 4,949,563 A 8/1990 Gerard et al.
7,764,159 B2 * 7/2010 Zanella ..... E05B 47/0009 337/139
(Continued)

FOREIGN PATENT DOCUMENTS

CN 1301894 A 7/2001
CN 102159758 A 8/2011
(Continued)

OTHER PUBLICATIONS

ISR and WO for PCT/US2014/050788 dated Apr. 23, 2015.

*Primary Examiner* — Mark A Williams
(74) *Attorney, Agent, or Firm* — Boyle Fredrickson, S.C.

(57) ABSTRACT

A door lock and an electrical appliance using the door lock. The door lock comprises: a switch housing; a pen core-like mechanism disposed in the switch housing; a control needle (state means) passing out of the pen core-like mechanism; and a manual unlocking pull rod mechanism. The manual unlocking pull rod mechanism is capable of moving towards the control needle and coming into contact therewith. The position of the control needle (state means) indicates the switch state of the door lock, such that when the door lock is in an unlocked position, further pulling of the manual unlocking pull rod mechanism has no effect on the door lock switch mechanism.

15 Claims, 10 Drawing Sheets

(51) Int. Cl.

| | |
|---|---|
| ***D06F 37/42*** | (2006.01) |
| ***E05C 1/08*** | (2006.01) |
| ***E05C 19/06*** | (2006.01) |

(58) Field of Classification Search

CPC ..... E05B 63/0069; E05B 47/0673; A47L 15/4259; A47L 2501/22; Y10T 70/7102; Y10T 292/0832; Y10T 292/0933; Y10T 292/0995; Y10T 292/1053; Y10T 292/106; F24C 15/022; F16C 2350/52; F16C 1/10; H01H 35/006

See application file for complete search history.

(56) References Cited

U.S. PATENT DOCUMENTS

| | | | | |
|---|---|---|---|---|
| 9,243,427 | B2 * | 1/2016 | Weber | E05B 47/0009 |
| 9,493,971 | B2 * | 11/2016 | Promutico | D06F 37/28 |
| 2002/0056998 | A1 | 5/2002 | Cho et al. | |
| 2006/0012190 | A1 * | 1/2006 | Alacqua | A47L 15/4259 292/341.16 |
| 2006/0033346 | A1 * | 2/2006 | Ala | A47L 15/4259 292/216 |
| 2011/0133490 | A1 | 6/2011 | Berginc | |
| 2015/0021927 | A1 | 1/2015 | Wang | |

FOREIGN PATENT DOCUMENTS

| | | | |
|---|---|---|---|
| CN | 102677983 | A | 9/2012 |
| EP | 1158125 | B1 | 11/2004 |
| JP | 0249883 | A | 2/1990 |
| WO | 2013109585 | A2 | 7/2013 |

* cited by examiner

LOCKING AND UNLOCKING MECHANISM FOR A DOOR LOCK

RELATED APPLICATIONS

The present application is a National Phase of International Application Number PCT/US2014/050788, filed Aug. 12, 2014, and claims priority to Chinese Application Number 201310473511.0, filed Oct. 11, 2013, and Chinese Application Number 201410178041.X, filed Apr. 29, 2014.

TECHNICAL FIELD

The present invention relates to a door lock for an electrical appliance, in particular to an electrical appliance door lock switch with manual release.

RELATED APPLICATION

The present invention incorporates the entire contents of the prior patent application with title "Electromagnetic door lock for electrical appliance" and application no. 201210072421.6 (agent document no. P013.01/ITW/CN) into the description of this patent application by reference.

BACKGROUND ART

Door lock switch mechanisms in existing electrical appliances (such as washing machines) have an unlocked and a locked position. Door lock switches of electrical appliances (such as washing machines) require that in certain circumstances (such as when the door lock switch control breaks down or when a sudden power cut occurs during operation of the electrical appliance), the door lock switch mechanism in the locked position is moved manually to the unlocked position, in order to open the door of the electrical appliance (e.g. washing machine).

Since existing door lock switches with a single-electromagnet structure incorporate a "push-push mechanism", once a user has pulled the manual release mechanism to push the door lock switch mechanism from the locked position to the unlocked position, if the user pulls the manual release mechanism a second time, to push the door lock switch mechanism, the door lock switch mechanism will return to the locked position from the unlocked position; if at this point the user pulls the manual release mechanism a third time, to push the door lock switch mechanism, the door lock switch mechanism will move from the locked position to the unlocked position again; if at this point the user pulls the manual release mechanism a fourth time, to push the door lock switch mechanism, the door lock switch mechanism will return to the locked position from the unlocked position again; and thus the cycle is repeated.

Although existing door lock switch mechanisms and door lock manual release mechanisms are able to satisfy the operational demands of electrical appliances (such as washing machines), the way in which they operate sometimes causes confusion and inconvenience in operation or assembly.

Thus, there is a need to provide an improved door lock switch mechanism and door lock manual release mechanism, such that once the door lock switch mechanism has moved from the locked position to the unlocked position, further pulling of the door lock manual release mechanism by the user will have no effect on the door lock switch mechanism.

DESCRIPTION OF THE ACCOMPANYING DRAWINGS

Figure 6:
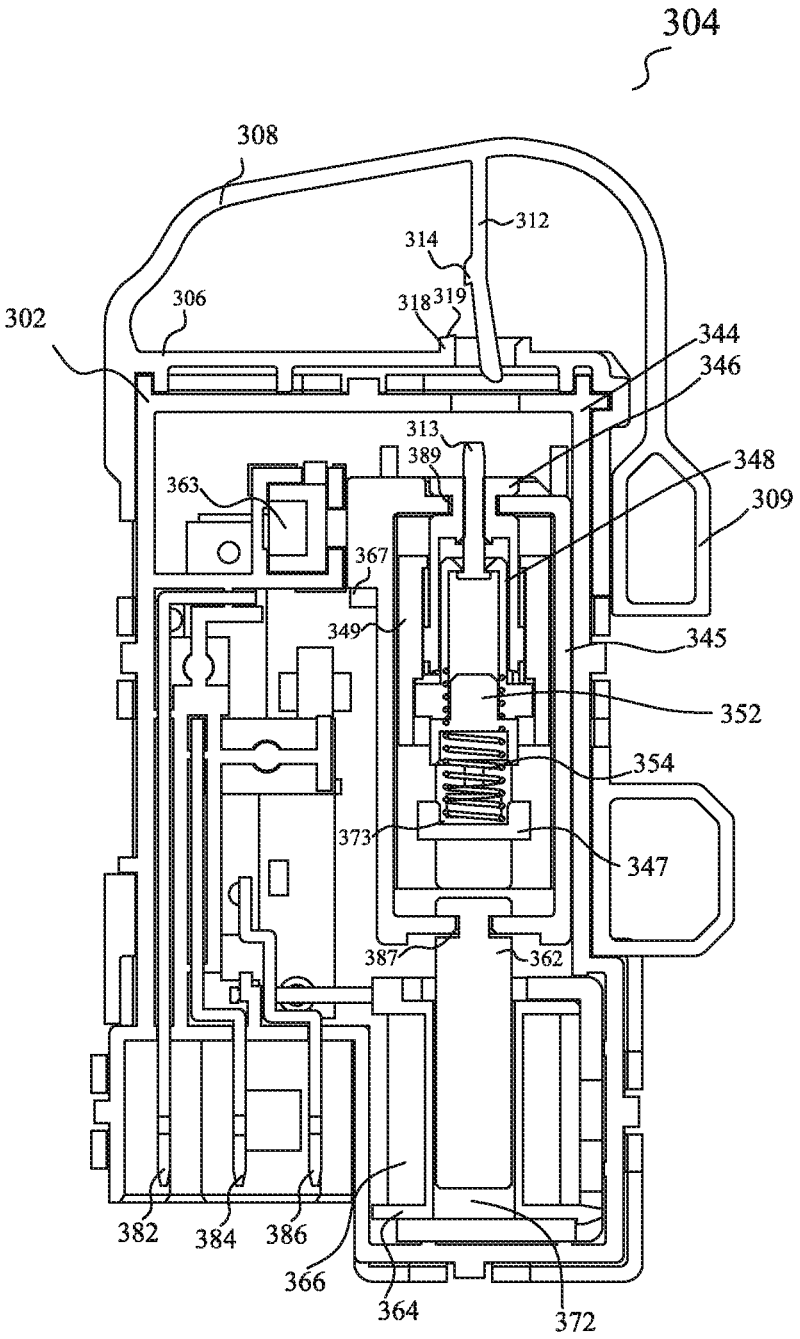
Figure 7:
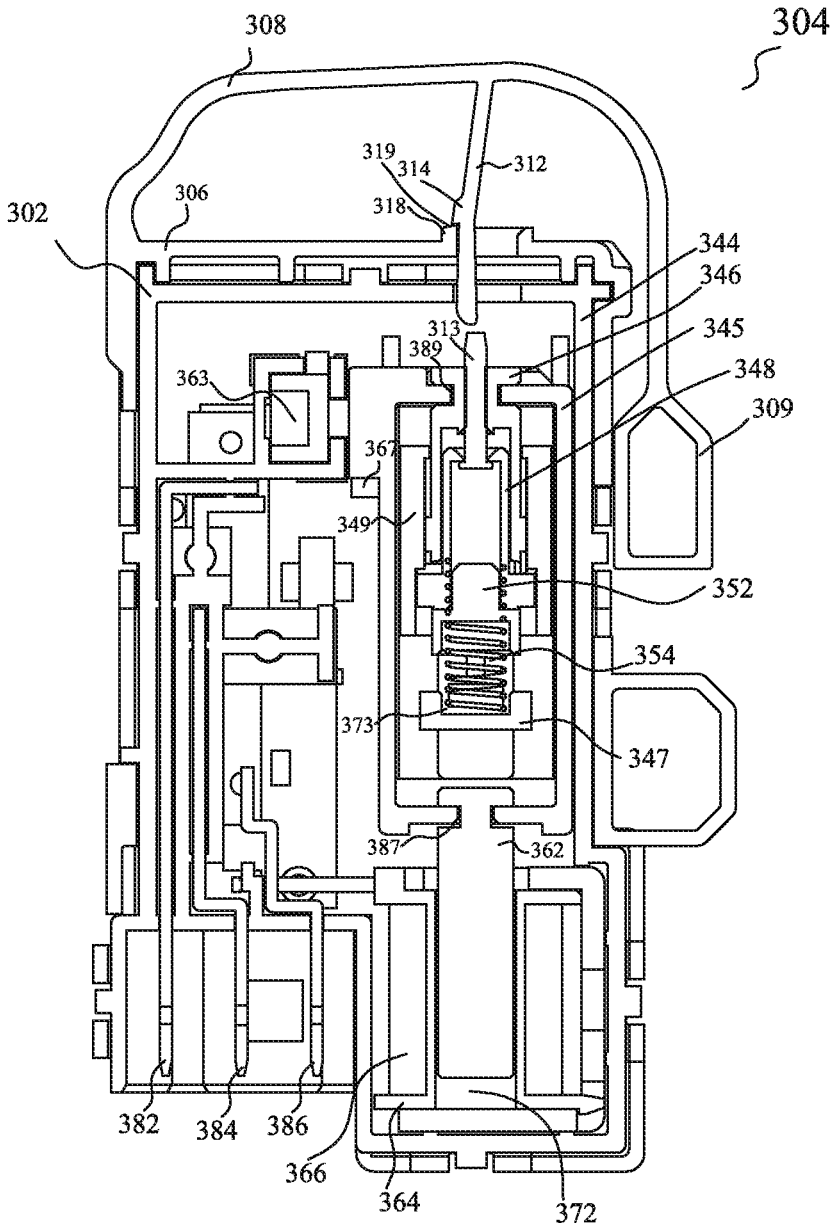
Figure 8:
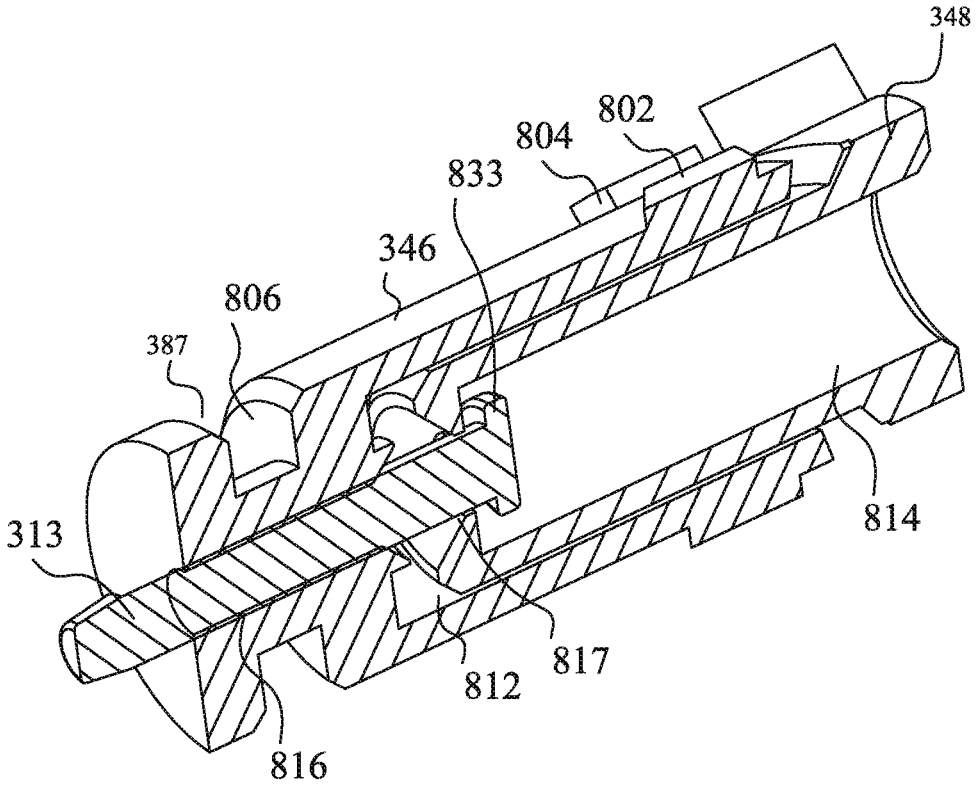
Figure 9:
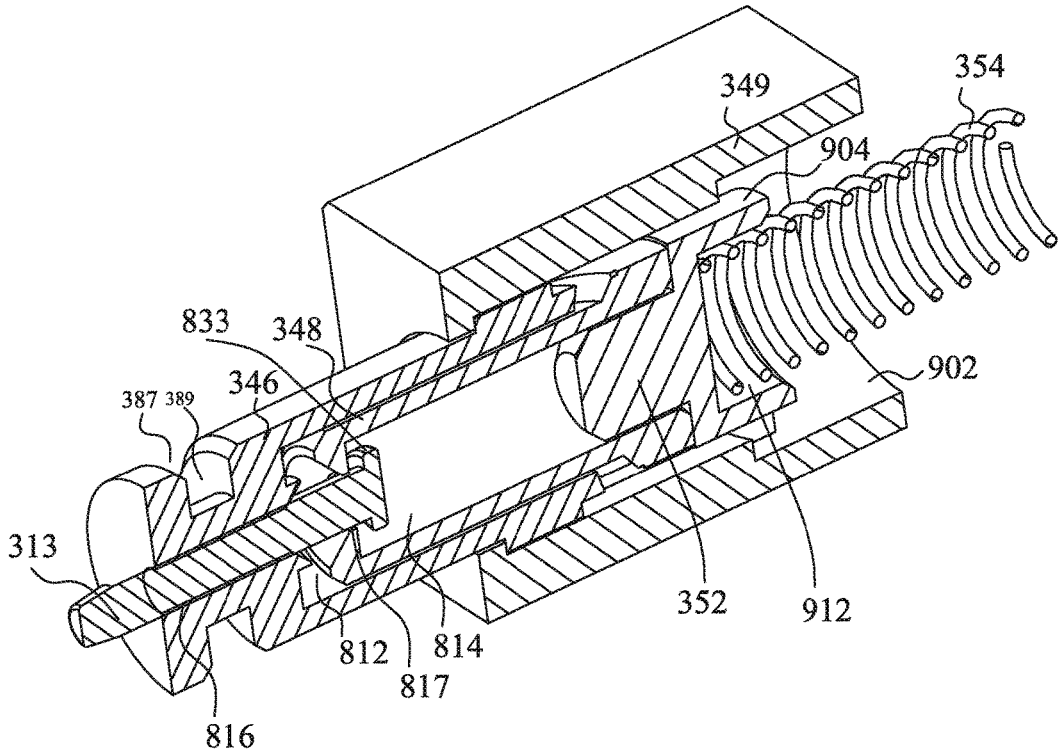
Figure 10:
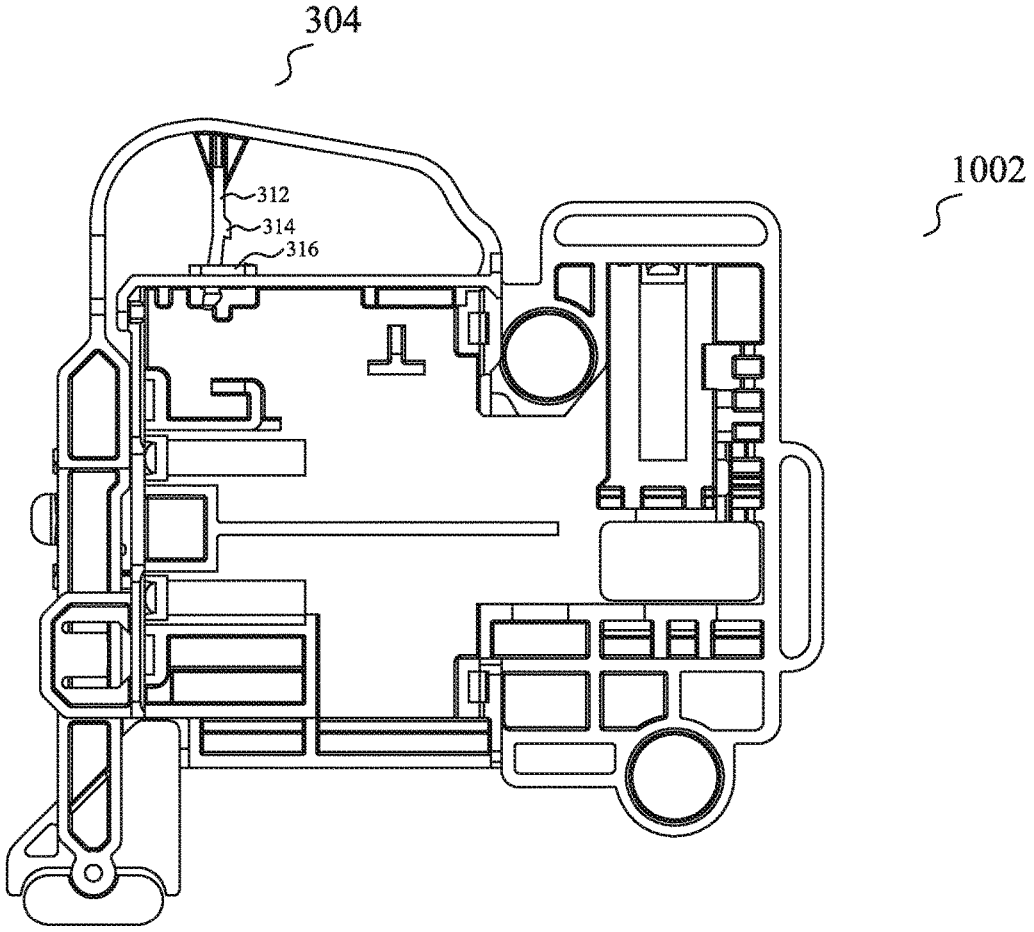

FIG. 6 shows the positional relationship between the end of the push rod 312 and the control needle 313 when the switch slide block 345 is in the unlocked position;

FIG. 7 shows the scenario where the manual pull rod 308 is pulled when the switch slide block 345 is in the unlocked position shown in FIG. 6;

FIG. 8 is a sectional view showing how the control needle 313, button (or pen core-like mechanism button) 346 and rotor (or pen core-like mechanism rotor) are assembled together;

FIG. 9 is a diagram showing how the switch driving mechanism (pen core-like mechanism) 344 is assembled;

FIG. 10 is the rear housing cover plate 1002 of the door lock 100 of the present invention, on which is provided the manual unlocking pull rod mechanism 304.

CONTENT OF THE INVENTION

To overcome the deficiencies in the prior art, on the one and the present invention provides a door lock, comprising: a manual unlocking means; a switch control means having an unlocked position and a locked position; and a state means, the position of which indicates the current position of the switch control means, to permit or forbid the manual unlocking means to move the switch control means; so that when the door lock switch mechanism is in the unlocked position, further pulling of the manual unlocking means has no effect on the door lock switch mechanism.

On the other hand, the present invention provides a door lock, comprising: a switch housing; a pen core-like mechanism disposed in the switch housing; a control needle passing out of the pen core-like mechanism; and an manual unlocking pull rod mechanism capable of moving towards the control needle and coming into contact therewith; such that when the door lock is in an unlocked position, further pulling of the manual unlocking pull rod mechanism has no effect on the door lock switch mechanism.

Furthermore, the state means (or control needle) of the present invention is a mechanical structure, which not only has a low production cost, but also operates reliably.

Embodiments

Various particular embodiments of the present invention are described below with reference to the accompanying drawings, which form part of this Description. It should be understood that although terms which indicate direction, such as "front", "rear", "upper", "lower", "left", "right", "perpendicular" or "parallel", are used in the present invention to describe components and elements of various exemplary structures thereof, these terms are only used herein to make description simpler, and are determined based on the exemplary directions shown in the drawings. Since the embodiments disclosed in the present invention may be arranged in different directions, these terms indicating direction are used purely for the sake of explanation and should not be regarded as restrictive. In the following drawings, identical components have the same label, while similar components have similar labels, to avoid the need to repeat descriptions.

Figure 1:
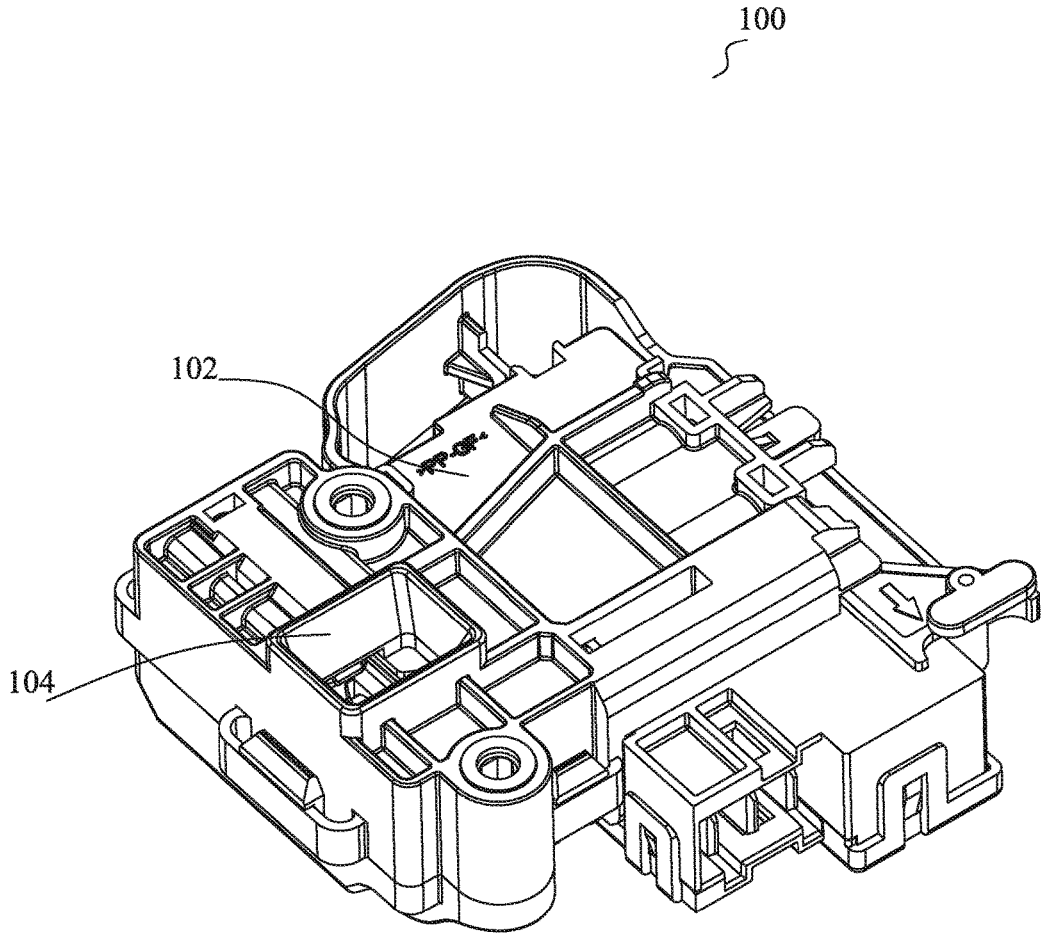
FIG. 1 is a perspective view of the exterior of a door lock 100 of the present invention.

FIG. 1 is a perspective view of the exterior of a door lock 100 of the present invention. As FIG. 1 shows, the components inside the door lock 100 are covered by the front housing cover plate 102, in which is provided a door hook hole 104 for receiving a door hook (not shown) on a door of an electrical appliance (such as a washing machine) in order to lock the door of the electrical appliance.

Figure 2:
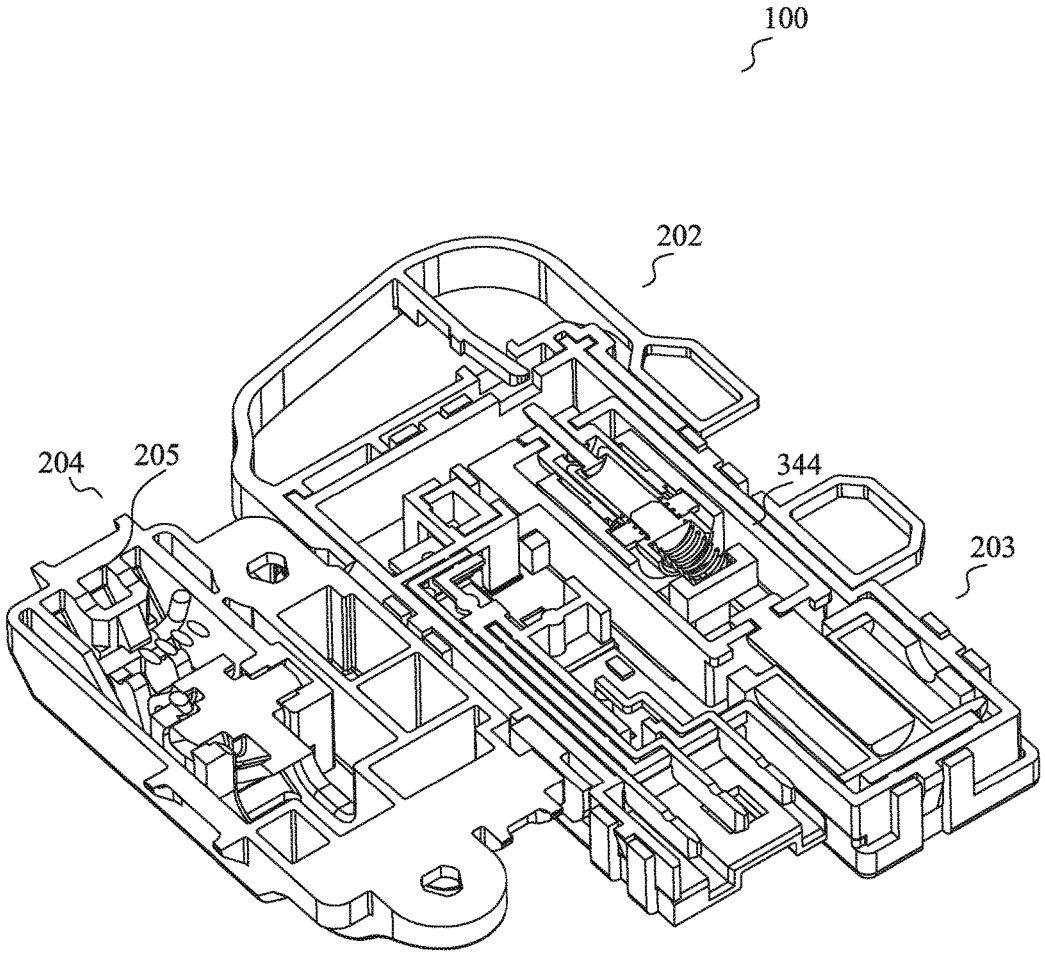
FIG. 2 is a perspective view of the door lock 100 of the present invention with the front housing cover plate 102 removed.

FIG. 2 is a sectional perspective view of the door lock 100 of the present invention, with the front housing cover plate 102 removed to show the door lock switch mechanism 202, electromagnetic driving mechanism 203 and door locking cam mechanism 204 inside the door lock 100. The door locking cam mechanism 204 is provided with a door hook hole 205, which is aligned with the door hook hole 104 provided in the front housing cover plate 102, and used to hook or release the door hook of the washing machine, so as to close or open the door. For those skilled in the art, omitting the details of the specific structure of the door locking cam mechanism 204 will not affect the understanding and description of the present invention, therefore the structure of the door locking cam mechanism 204 has been omitted in FIGS. 3-7, and is not described in further detail.

Figure 3:
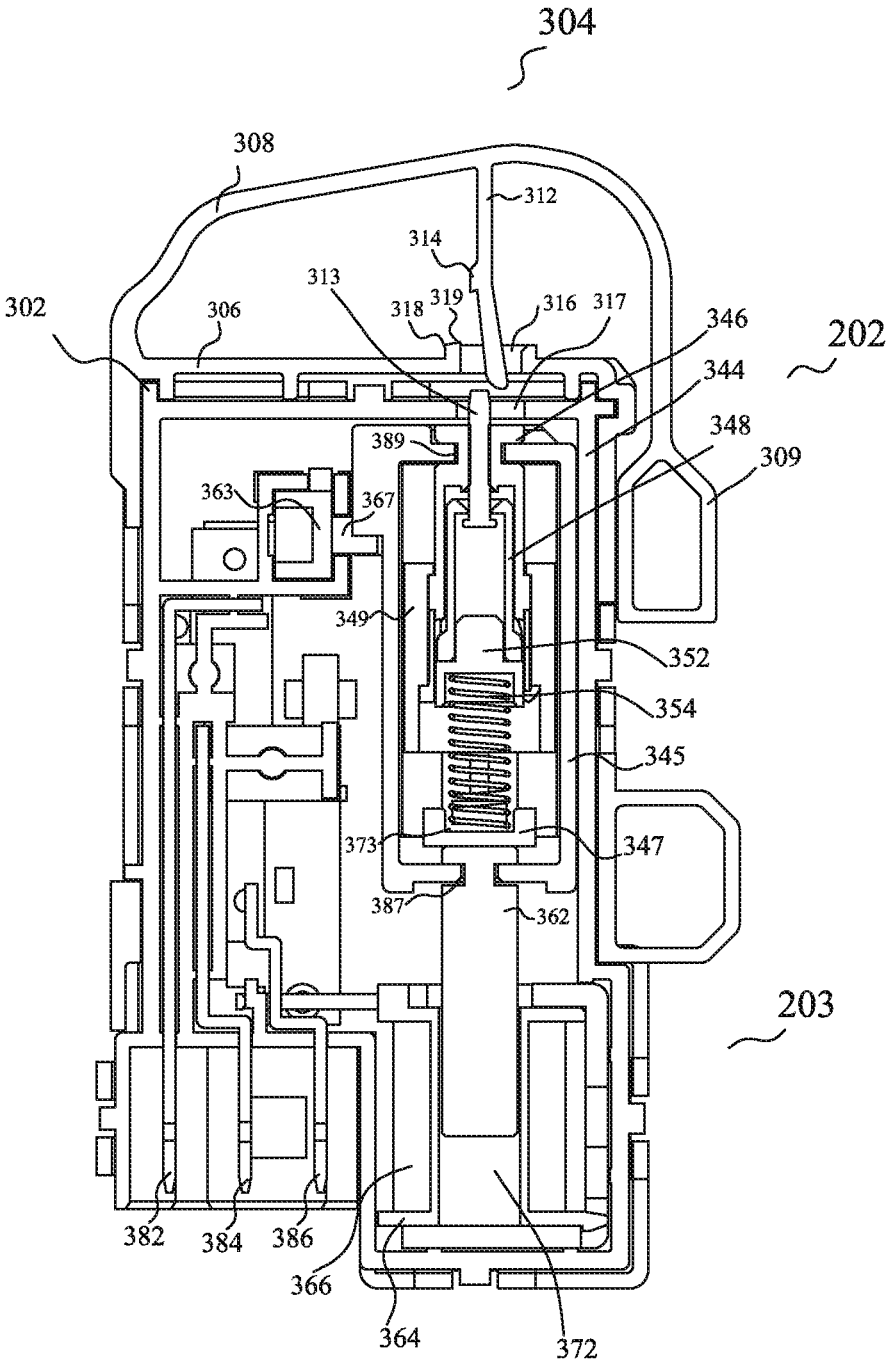
FIG. 3 is a sectional view of the door lock switch mechanism 202 of the present invention.

FIG. 3 is a sectional view of the door lock switch mechanism 202 of the present invention. The door lock switch mechanism 202 comprises a switch housing 302, a manual unlocking pull rod mechanism 304 disposed above the switch housing 302, and a switch driving mechanism 344 installed in the switch housing 302. In one embodiment, the mechanism in the switch driving mechanism 344 in the present invention resembles the pen core mechanism of a ballpoint pen, that is: if the switch driving mechanism 344 is pressed down and then released, the switch driving mechanism 344 moves down and remains in a lower position (unlocked position); if the switch driving mechanism 344 is pressed down again and then released, the switch driving mechanism 344 moves up and returns to an upper position (locked position); if the switch driving mechanism 344 is pressed down again and then released, the switch driving mechanism 344 moves down again and remains in a lower position (unlocked position), and thus the cycle is repeated.

As FIG. 3 shows, the manual unlocking pull rod mechanism 304 comprises a base 306 disposed at one end (or the top end) of the switch housing 302. A shoulder (or projecting shoulder) 318 is provided on the base 306, with a through hole 316 provided at the shoulder (or projecting shoulder) 318. A manual pull rod 308 extends out of one end (or the left end) of the base 306, while a manual pull rod handle 309 extends out of a remote end of the manual pull rod 308. Between an arm end of the manual pull rod 308 (i.e. the end connected with the base 306) and a remote end (i.e. 309) is provided a push rod 312; a step (or protrusion) 314 is provided on the push rod 312, the step 314 extending obliquely downwards (or obliquely downwards to the left), and forming an angle with the push rod 312. One side (or the left side) of the shoulder (or projecting shoulder) 318 is provided with a bevel surface 319 matching the angle of the step 314; so that when the push rod 312 bears against the left side of the shoulder (or projecting shoulder) 318, the push rod 312 is caught more effectively. Of course, in the absence of the shoulder (or projecting shoulder) 318, the push rod 312 can still be caught by a left sidewall of the through hole 316. The position of the push rod 312 on the manual pull rod 308 must be able to ensure that when the manual pull rod 308 is pulled, the push rod 312 can move downwards and enter the through hole 316. An opening 317 in communication with the through hole 316 is provided at the top of the switch housing 302; the shoulder (or projecting shoulder) 318 is disposed over the opening 317. Therefore, when the manual pull rod 308 is pulled, the push rod 312 can pass through the through hole 316 and the opening 317 and enter the interior of the switch housing 302.

As can be seen from FIG. 3, the manual pull rod 308 is a curved component in the form of a thin sheet, with one end (or the arm end) fixed to one end (or the top left end) of the switch housing 302. When the other end (the remote end) is pulled down, the movement of the manual pull rod 308 is that of a lever hinged at one end of the top of the switch housing 302 (the top left end), the lever rotating around the joint (the left end of the top of the switch housing 302). Therefore, when the manual pull rod 308 rotates around the left end of the top of the switch housing 302, the direction of movement of the push rod 312 may be resolved into movement in two directions, namely the horizontal direction and the vertical direction. In other words, when the manual pull rod 308 is pulled, the push rod 312 moves not only downwards but also towards the left side of the through hole 316.

Referring to FIG. 3, the switch driving mechanism 344 comprises a switch slide block (or pen core-like mechanism slide block) 345, in which are installed a button (or pen core-like mechanism button) 346, a rotor (pen core-like mechanism rotor) 348, a support 349, a spring seat 352, and a reset spring 354. The button 346 has a cylindrical cavity (see 812 in FIG. 8), the top of the button 346 being fixed by means of a locking groove 389 thereof at the upper end of the switch slide block 345. The cylindrical rotor 348 is installed in the cylindrical cavity 812 of the button 346. The cylindrical rotor 348 also has a cylindrical cavity (see 814 in FIG. 8), which is fitted over a cylindrical head of the spring seat 352. The bottom of the spring seat 352 has a recess (see 912 in FIG. 9), for receiving one end of the reset spring 354, the other end of the reset spring 354 being fitted in a recess 373 of a spring cradle 347. The button 346, rotor 348, support 349, spring seat 352 and reset spring 354 are assembled in the switch slide block 345. A head of the button 346 has a through hole (see 816 in FIG. 8), and the top of the rotor 348 has an opening (see 817 in FIG. 8); at the top of the rotor 348 is installed a control needle 313, which extends out of the top of the button 346 via the through hole 816 in the button 346 and the opening 817 in the top of the rotor 348. Furthermore, starting at the step 314 on the push rod 312, the lower portion of the push rod 312 extends obliquely downwards to one side (the right side), so as to be offset laterally (to the right) with respect to the control needle 313. In the present invention, in coordination with the push rod 312, the position of the control needle 313 marks (or indicates) the positional state of the switch driving mechanism 344 to the push rod 312. Since the control needle 313, as an indication device, is a relatively simple mechanical structure, the production costs are low, while operation is reliable.

The electromagnetic driving mechanism 203 comprises an iron core 362, a coil support 364 with a cavity 372, and a coil 366 wound on the outside of the coil support. One end of the iron core 362 is arranged inside the cavity 372 of the coil support 364, the other end pushing against the spring cradle 347; this other end of the iron core 362 is fixed by means of a locking groove 387 thereof to the lower end of the switch slide block 345. When a current is passed through the coil 366, the iron core 362 experiences a downward pulling force, which pulls the switch slide block (or pen core-like mechanism slide block) 345 down to the unlocked position. Three plug pins (382, 384, 386) can supply two driving power supply sets, wherein plug pin 384 is the common plug pin, which together with plug pin 382 supplies power to the driving coil, and together with plug pin 386 supplies power to the washing machine motor (not shown). It should be noted that the functionality of the electromagnetic driving mechanism 203 is limited to electromagnetic driving in a single direction (i.e. pulling downwards); it cannot push the switch slide block (or pen core-like mechanism slide block) 345 upwards. Therefore the function of pushing up the switch slide block (or pen core-like mechanism slide block) 345 is served by the reset spring 354. A unidirectional electromagnetic driving circuit has a simpler structure and lower production costs than a bidirectional electromagnetic driving circuit.

As FIG. 3 shows, a sliding catch block 363 is provided at a side part of the switch slide block (or pen core-like mechanism slide block) 345, a guiding pin 367 being provided on the sliding catch block 363; a guiding oblique groove (not shown) is provided at a side part of the switch slide block 345, and the guiding pin 367 on the sliding catch block 363 is inserted in the guiding oblique groove of the switch slide block 345. Under the control of the switch slide block 345, the sliding catch block 363 moves perpendicular to the paper (i.e. the direction of movement thereof is perpendicular to the direction of movement of the switch slide block 345). Specifically, when the switch slide block 345 is in the unlocked position, the guiding oblique groove of the switch slide block 345 raises the sliding catch block 363 perpendicular to the paper, so that switch contacts (not shown) cannot close; when the switch slide block 345 is in the locked position, the guiding oblique groove on the switch slide block 345 releases the sliding catch block 363, so that it falls, in order for the switch contacts (not shown) to close.

The operation process of the present invention is now described in conjunction with the accompanying drawings. As FIG. 3 shows, when the switch slide block 345 is in the locked position, the switch slide block 345 is in an upper position in the switch housing 302, the control needle 313 projects from the opening 317 in the top end of the switch housing 302, and is close (or adjacent) to the through hole 316 in the manual unlocking pull rod mechanism base 306; in other words, when the switch slide block 345 is in the locked position, the control needle 313 is close (or adjacent) to the end of the push rod 312. Since the lower end of the push rod 312 is inclined to one side (the right side), before the manual pull rod 308 is pulled, the push rod 312 is offset to the right, with the end of the push rod 312 being positioned on the right side of the control needle 313.

Figure 4:
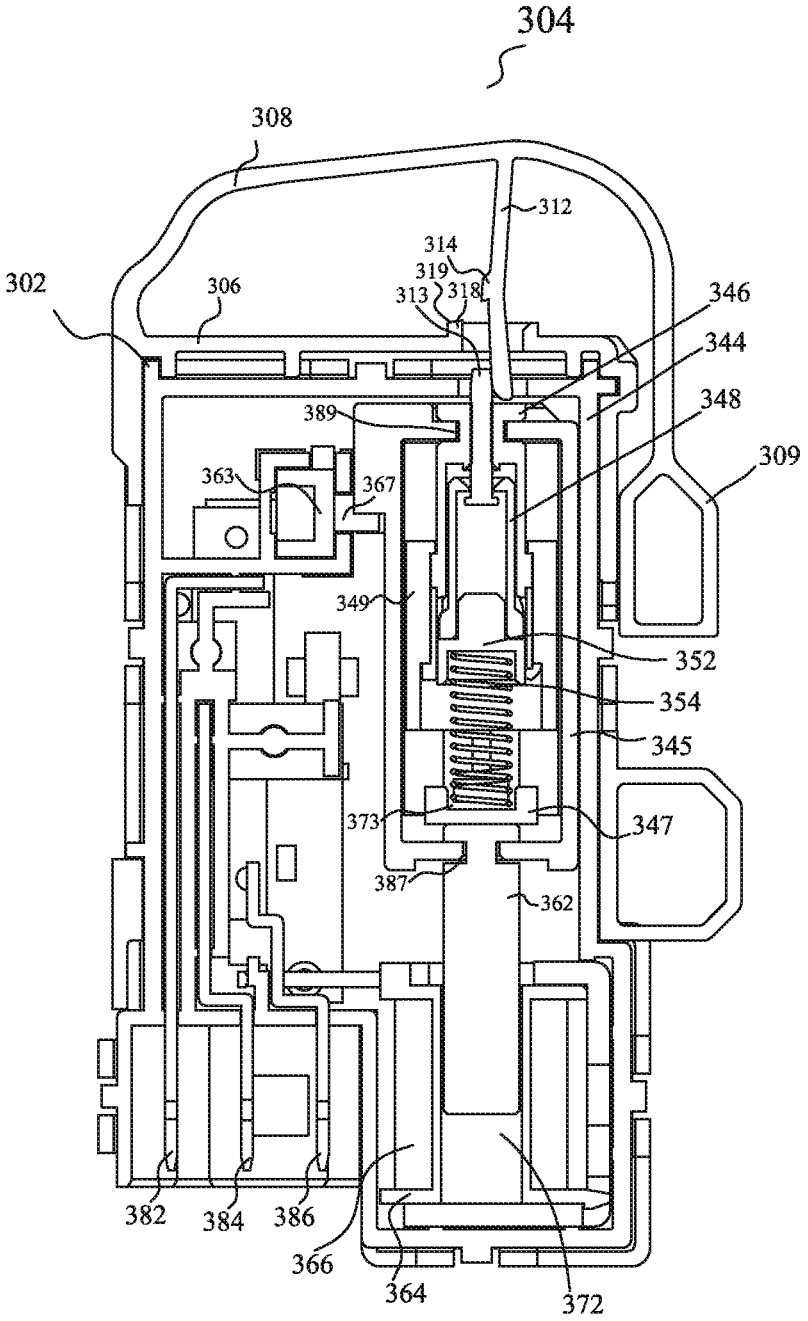
FIG. 4 shows the scenario where the manual pull rod 308 begins to be pulled when the switch slide block 345 is in the locked position.

FIG. 4 shows the scenario where the manual pull rod 308 begins to be pulled when the switch slide block 345 is in the locked position. As shown in FIG. 3, when the switch slide block 345 is in the locked position, the control needle 313 is close (or adjacent) to the end of the push rod 312. As FIG. 4 shows, the design of the manual unlocking pull rod mechanism 304 ensures that the push rod 312 sticks against the right side of the control needle 313, forcing the control needle 313 and button 346 to move downwards.

Figure 5:
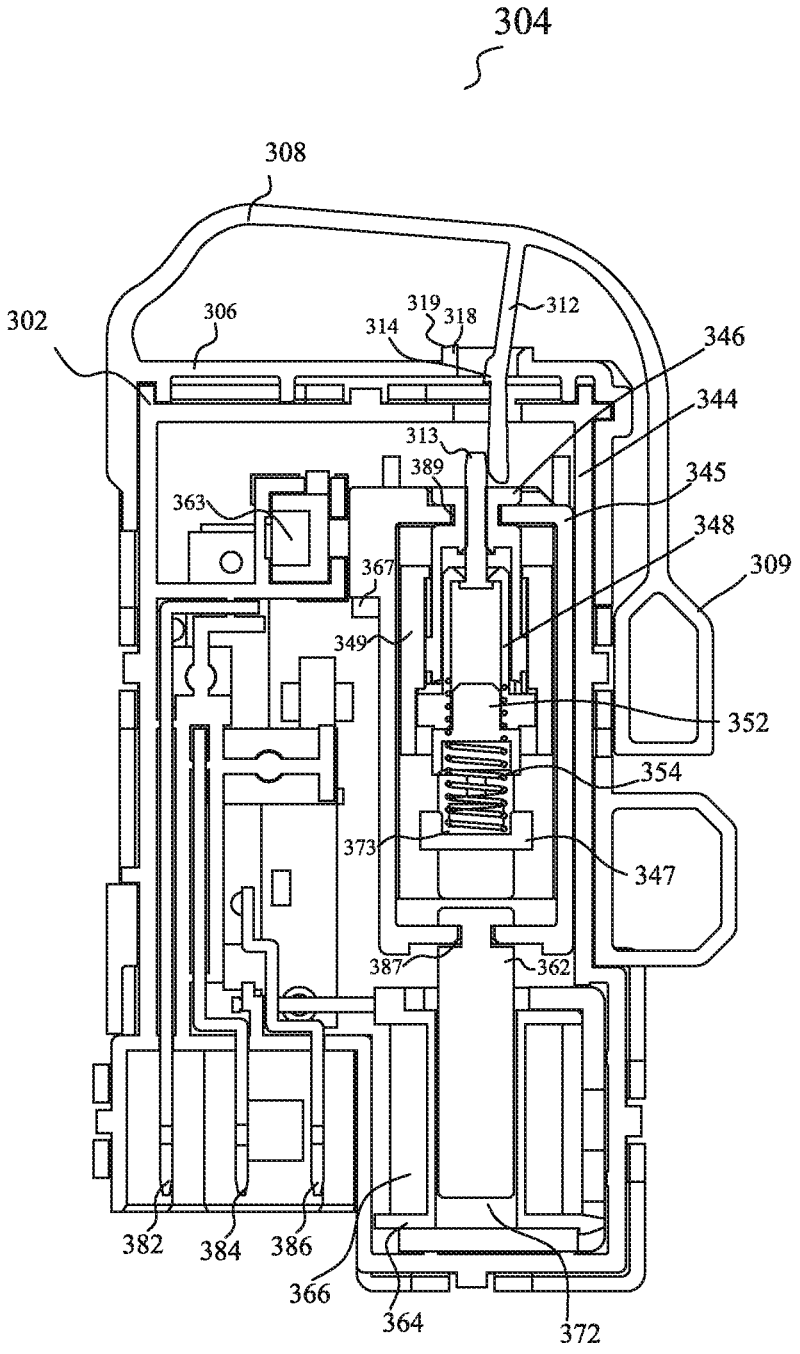
FIG. 5 shows the scenario where the manual pull rod 308 is pulled further down from the position shown in FIG. 4.

FIG. 5 shows the scenario where the manual pull rod 308 is pulled further down from the position shown in FIG. 4. At this point the control needle 313 continues to move downwards against the spring force of the reset spring 354, pushing the switch slide block 345 down. Once the switch slide block 345 has moved down a certain distance, the pen core-like mechanism in the switch slide block 345 passes a conversion point position, so that even if the downward pushing force is removed, the switch slide block 345 can still remain in the lower unlocked position.

FIG. 6 shows the positional relationship between the end of the push rod 312 and the control needle 313 when the switch slide block 345 is in the unlocked position. As FIG. 6 shows, when the switch slide block 345 is in the unlocked position, the switch slide block 345 is in a lower position in the switch housing 302, and the control needle 313 is distant from the end of the push rod 312.

FIG. 7 shows the scenario where the manual pull rod 308 is pulled when the switch slide block 345 is in the unlocked position shown in FIG. 6. At this point, since the control needle 313 is distant from the end of the push rod 312, the control needle 313 presents no obstruction to the push rod 312, and the push rod 312 moves to the left while moving downwards; once the push rod 312 has moved down a certain distance, the step 314 on the push rod 312 is caught by the bevel surface on the left side of the shoulder (or projecting shoulder) 318, so that the push rod 312 cannot contact the button (or pen core-like mechanism button) 346, preventing the switch slide block 345 from returning to the locked position from the unlocked position.

FIG. 8 is a sectional view showing how the control needle 313, button (or pen core-like mechanism button) 346 and rotor (or pen-core like mechanism rotor) 348 are assembled together. As FIG. 8 shows, the button 346 has a cylindrical cavity 812, the cylindrical rotor 348 being installed in the cylindrical cavity 812 of the button 346. The cylindrical rotor 348 also has a cylindrical cavity 814, and at the top of the rotor 348 is installed a control needle 313, which extends out of the top of the button 346 via the through hole 816 in the head of the button 346 and the opening 817 in the top of the rotor 348. The bottom end of the control needle 313 has a bottom disc 833, the diameter of the bottom disc 833 being larger than that of the opening 817 of the rotor 348, so that when the control needle 313 is pushed into the cavity 814 of the rotor 348 during assembly, it will stop at the head end of the cavity 814. The diameter of the control needle 313 is chosen to achieve a tight fit with the inner diameter of the through hole 816 in the head of the button 346, so that when the control needle 313 is moved, the button 346 moves with it.

FIG. 9 is a sectional view showing how the switch driving mechanism (or pen core-like mechanism) 344 is assembled. As FIG. 9 shows, the switch driving mechanism 344 comprises: a control needle 313, a button 346, a support 349, a spring seat 352, and a reset spring 354. The button 346 has a cylindrical cavity 812, the cylindrical rotor 348 being installed in the cylindrical cavity 812 of the button 346. The cylindrical rotor 348 also has a cylindrical cavity 814, which is fitted over a cylindrical head of the spring seat 352. The bottom of the spring seat 352 has a recess 912, for receiving one end of the reset spring 354, the other end of the reset spring 354 being fitted in a recess 373 of a spring cradle 347. The button 346, rotor 348, spring seat 352 and reset spring 354 are assembled in/on the support 349. An opening is provided in the top of the button 346 and in the top of the rotor 348; at the top of the rotor 348 is installed a control needle 313, which extends out of the top of the button 346 via the openings in the top of the button 346 and the top of the rotor 348. During operation, the support 349 is fixed in place and does not move; the button 346 can slide to and fro, but cannot rotate; the rotor 348 has a common axis with the button 346, and is rotatable while sliding to and fro along with the button 346. Locating structures (not shown) which engage with each other are provided in an interior 902 of the support 349 and on a cylindrical distant end of the rotor 348, enabling the button 346 to be retained in two positions (i.e. the locked position and unlocked position).

FIG. 10 is the rear housing cover plate 1002 of the door lock 100 of the present invention, on which is provided the manual unlocking pull rod mechanism 304. The front housing cover plate 102 in FIG. 1 is combined with the rear housing cover plate 1002 to form the housing 302 of the door lock 100. The housing of the door lock 100 in the present invention may be made of PP or PA nylon.

As a particular application, the door lock 100 of the present invention may be fixed to the door of a washing machine, to lock or unlock the washing machine door.

The invention claimed is:

1. A door lock, wherein it comprises:

a manual unlocking means providing a handle exposed to be operable by a user;

a switch control means operable to move between an unlocked position unlocking the door and a locked position locking the door; and a state means communicating with the switch control means to move therewith providing a position indicating a current position of the switch control, the state means interacting with the manual unlocking means to permit or forbid the manual unlocking means to move the switch control means depending on the position of the state means;

wherein: the state means is a mechanical means;

wherein: the manual unlocking means comprises a manual pull handle and a push rod, the push rod is provided with a stopping means, the manual unlocking means is further provided with blocking means, which is configured to block the stopping means on the push rod; and wherein the state means permits or forbids the push rod to move the switch control means depending on the position of the state means;

wherein the door lock further comprises: a switch housing which includes an opening; and wherein the manual unlocking means is disposed on the switch housing; and wherein the switch control means is disposed in the switch housing; the opening on the switch housing enables the push rod to enter the switch housing to move the switch control means;

wherein: when the position of the state means indicates that the switch control means is in the locked position, the stopping means on the push rod is not limited by the blocking means and thereby can enter an interior of the switch housing and contact with the switch control means to move the switch control means from the locked position to the unlocked position; when the position of the state means indicates that the switch control means is in the unlocked position, the stopping means on the push rod is limited by the blocking means and thereby cannot contact with the switch control means.

2. The door lock according to claim 1, wherein: the manual unlocking means further comprises: a shoulder disposed over the opening, a through hole is provided at the shoulder; one end of the push rod is connected to one end of the manual pull handle; the other end of the push rod is a pull end of the manual pull handle.

3. The door lock according to claim 2, wherein: the blocking means is a sidewall of the through hole; the stopping means on the push rod is a protrusion or step disposed on the same side as the sidewall of the through hole.

4. The door lock according to claim 1, wherein the door lock further comprises: a switch slide block disposed on the switch control means; the switch slide block is configured to stay at a first position or a second position, i.e., the switch control means has the unlocked position and the locked position.

5. The door lock according to claim 4, further including: an electromagnetic driving means is configured to drive the switch slide block.

6. An electrical appliance, wherein it uses the door lock according to claim 1.

7. A door lock, wherein it comprises:

a manual unlocking means providing a handle exposed to be operable by a user;

a switch control means operable to move between an unlocked position unlocking the door and a locked position locking the door; and a state means communicating with the switch control means to move therewith providing a position indicating a current position of the switch control, the state mean interacting with the manual unlocking means to permit or forbid the manual unlocking means to move the switch control means depending on the position of the state means;

wherein: the state means is a mechanical means;

wherein: the manual unlocking means comprises a manual pull handle and a push rod, the push rod is provided with a stopping means, the manual unlocking means is further provided with blocking means, which is configured to block the stopping means on the push rod; and wherein the state means permits or forbids the push rod to move the switch control means depending on the position of the state means;

wherein the door lock further comprises: a switch housing, which includes an opening; the manual unlocking means is disposed on the switch housing; the switch control means is disposed in the switch housing; the opening on the switch housing enables the push rod to enter the switch housing to move the switch control means, wherein: the manual unlocking means further comprises: a shoulder disposed over the opening, a through hole is provided at the shoulder; one end of the push rod is connected to one end of the manual pull handle; the other end of the push rod is a pull end of the manual pull handle;

wherein: the blocking means is a sidewall of the through hole; the stopping means on the push rod is a protrusion or step disposed on the same side as the sidewall of the through hole, wherein: the protrusion or step on the push rod has a downward inclination angle; one side of the shoulder has an inclination angle corresponding to the protrusion or step.

8. A door lock, wherein it comprises: a switch housing; a pen core-like mechanism disposed in the switch housing; a control needle extending out of the pen core-like mechanism; and an manual unlocking pull handle mechanism capable of moving towards the control needle and contacting with the control needle;

wherein: the manual unlocking pull handle mechanism comprises a manual pull handle, the manual pull handle is provided with a push rod the push rod is provided with a step, the switch housing is provided with an opening so that the push rod can pass through the opening into the switch housing; a base is provided at one end of the switch housing, with a through hole provided in the base; one end of the base is connected to one end of the manual pull handle, the manual pull handle is pulled so that the push rod generates horizontal movement and downward movement; after the push rod moves horizontally above the through hole a predetermined distance, one side of the through hole catches the push rod to stop it from moving downwardly; when the pen core-like mechanism is at a locked position, the control needle gets adjacent to the through hole to block the horizontal movement of the push rod; when the pen core-like mechanism is at an unlocked position, the control needle gets away from the through hole to release the horizontal movement of the push rod.

9. The door lock according to claim 8, wherein: the manual unlocking pull handle mechanism is disposed on the switch housing.

10. The door lock according to claim 8, wherein: at an inlet of the through hole is provided with a shoulder; after the push rod moves horizontally above the through hole a predetermined distance, one side of the step is caught by one side of the through hole to prevent the push rod from getting into the switch housing.

11. The door lock according to claim 10, a bevel surface is provided on one side of the shoulder; the step on the push rod has an inclination angle relative to the push rod; the inclination angle matches with the bevel surface; after the push rod moves horizontally above the through hole a predetermined distance, the bevel surface of the shoulder catches the step on the push rod to prevent the push rod from getting into the switch housing.

12. The door lock according to claim 8, wherein the pen core-like mechanism comprises: a button; a rotor, installed in a cylindrical cavity of the button; the control needle is provided on the rotor, and extending out of a top end of the button.

13. The door lock according to claim 12, wherein the pen core-like mechanism further comprises: a spring seat; a reset spring, which is mounted on the spring seat.

14. The door lock according to claim 12, wherein the pen core-like mechanism has a locked position and an unlocked position.

15. The door lock according to claim 14, wherein it further comprises: an electromagnetic driving mechanism for unidirectionally driving the pen core-like mechanism.

* * * * *